US008707597B1

(12) United States Patent
Cavalieri

(10) Patent No.: US 8,707,597 B1
(45) Date of Patent: Apr. 29, 2014

(54) PORTABLE SIGNAGE DISPLAY APPARATUS

(71) Applicant: Dino Cavalieri, Schumacher (CA)

(72) Inventor: Dino Cavalieri, Schumacher (CA)

( * ) Notice: Subject to any disclaimer, the term of this patent is extended or adjusted under 35 U.S.C. 154(b) by 50 days.

(21) Appl. No.: 13/655,809

(22) Filed: Oct. 19, 2012

(51) Int. Cl.
*G09F 7/10* (2006.01)

(52) U.S. Cl.
CPC ..... *G09F 7/10* (2013.01)
USPC ..... 40/611.06; 40/605

(58) Field of Classification Search
CPC ..... G09B 15/08; G09F 7/08; G09F 7/10
USPC ..... 40/606.18, 606.14, 611.06, 611.07
See application file for complete search history.

(56) References Cited

U.S. PATENT DOCUMENTS

| | | | | |
|---|---|---|---|---|
| 1,403,669 | A | 1/1922 | Chouinard | |
| 1,644,742 | A | 10/1927 | Moynihan | |
| 4,630,386 | A * | 12/1986 | Wilson | 40/734 |
| 4,884,351 | A | 12/1989 | Abramson | |
| 5,331,757 | A * | 7/1994 | Ernest et al. | 40/611.12 |
| 5,377,434 | A * | 1/1995 | Wilson | 40/611.06 |
| 5,588,238 | A | 12/1996 | Visocky | |
| 5,666,751 | A * | 9/1997 | Garfinkle | 40/605 |
| 5,987,794 | A * | 11/1999 | Lavi et al. | 40/611.04 |
| 6,009,651 | A * | 1/2000 | Current | 40/605 |
| 6,076,295 | A * | 6/2000 | Garfinkle | 40/605 |
| 6,108,955 | A | 8/2000 | Folsom et al. | |
| 6,119,384 | A * | 9/2000 | Fischer | 40/606.02 |
| 6,322,174 | B1 * | 11/2001 | Palmqvist | 312/114 |
| 6,493,974 | B2 * | 12/2002 | Tramont | 40/606.19 |
| 6,618,974 | B2 * | 9/2003 | Szalay | 40/611.06 |
| 6,785,993 | B1 * | 9/2004 | Lea | 40/643 |
| 2006/0185203 | A1 * | 8/2006 | Bittle et al. | 40/541 |
| 2009/0151212 | A1 * | 6/2009 | Cadavis | 40/611.07 |
| 2009/0217561 | A1 | 9/2009 | Thompson | |
| 2009/0289183 | A1 * | 11/2009 | Chen et al. | 250/282 |
| 2011/0030252 | A1 * | 2/2011 | Marinakis | 40/549 |

* cited by examiner

*Primary Examiner* — Shin Kim
(74) *Attorney, Agent, or Firm* — Montgomery Patent & Design; Robert C. Montgomery

(57) ABSTRACT

A moisture-protected, bi-directionally viewable portable sign display having a rectangular frame with a removable side that enables configuring a plurality of indicia bearing signs and which is supported by a removable support structure that includes features to prevent moisture damage.

20 Claims, 7 Drawing Sheets

PORTABLE SIGNAGE DISPLAY APPARATUS

RELATED APPLICATIONS

Not Applicable.

FIELD OF THE INVENTION

The presently disclosed invention is directed towards advertising display signs. More particularly, the present invention relates to a moisture protected, bi-directional portable sign display having a rectangular frame with a removable side that enables configuring a plurality of signs having indicia and which is supported by a removable support structure that includes features to prevent moisture damage.

BACKGROUND OF THE INVENTION

Relatively recent changes in American society mean that mass advertisers can no longer simply rely on television commercials and magazine ads to get their products noticed. Today's consumer is often much more knowledgeable and leads a lifestyle which does not expose them to conventional advertising mediums and the associated repetitious jingles of days past.

While "over-the-air" television viewership is down, cable television does not readily fill the advertising void because they may not have a suitable advertising viewership or structure, satellite radio systems in cars do not have commercials, and the Internet often uses specific targeting methods for advertising while missing the general population. Additionally, today's consumers readily see through marketing hype and are not likely to be swayed by advertising that serves no purpose in their lives.

While traditional advertising venues are not as effective as they once were and while many newer advertising venues are limited in effectiveness, people continue to drive. Thus the curb-side along roads, highways, and sidewalks remain a viable advertising location.

However, the need for advertising that supplies useful marketing information remains. Beneficially such advertising should be presented in a unique and eye-catching way.

Accordingly, there exists a need for a way to present marketing and promotional information in an eye catching, fun-filled, and different manner. Ideally that way would always be visible, attention grabbing, would effectively improve sales, and would be relatively low in both initial cost and long term maintenance.

SUMMARY OF THE INVENTION

The principles of the present invention provide for a device that provides promotional information in an eye catching, fun-filled, and different manner. That device can be implemented at low cost and can be used in a way that is always visible and attention grabbing.

A portable display that is in accord with the invention has a frame assembly with a three-sided structure comprised of a top, a fixed side, and a bottom. The top and fixed sides include first slots, second slots, and storage slots that are disposed between the first and second slots. The frame assembly further includes a downward protruding insert. The portable display also includes a removable side that is configured to be received by the top and bottom. Also included is a horizontal support structure with a receiver for receiving the insert, and at least one (1) adjustable leg that is attached to the horizontal support structure. The first slots are configured to retain a first sign panel to be visible from a first direction, the second slots are configured to retain a second sign panel to be visible from a second direction, while the storage slots are configured to store at least one (1) sign panel.

Beneficially the portable display includes at least two (2) sign panels having indicia on both sides and which are made from a rugged weather-resistant material. Preferably the bottom is an open structure having two (2) vertical side plates and a plurality of interconnecting rods. A mating plate is available for attaching the removable side to the top. In practice threaded apertures will be use to retain the removable side to the mating plate Another portable display that is in accord with the present invention includes a frame assembly having a top and a fixed side with first slots, second slots, and storage slots and an open frame bottom attached at one (1) end to the fixed side. The bottom includes two (2) vertical side plates and a plurality of interconnecting rods. The frame assembly further includes a first downward protruding first insert that is received by a first horizontal support structure. A removable side is configured to be received by the top and bottom while the first horizontal support structure is used to attach a first leg. The first slots are configured to retain a first sign panel visible from a first direction, the second slots are configured to retain a second sign panel visible from a second direction, and the storage slots are configured to retain at least one non-viewable sign panel.

The portable display beneficially includes a first sign panel inserted into the first slots, a second sign panel inserted into the second slots, and a third sign panel inserted into the storage slots. Preferably at least the first sign panel has indicia on both sides. The portable display preferably further includes a mating plate for attaching the removable side to the top and threaded apertures for retaining the removable side to the mating plate. The removable side may include a first exterior slot aligned with the first slots and a second exterior slot aligned with the second slots. In practice the removable side may include a downward protruding second insert and a mounting plate for attaching to the bottom. A second horizontal support structure having a second receiver can receiving the second insert, while a second leg having an aperture can be attached to the second horizontal support structure.

Yet another portable display that is in accord with the present invention may include a frame assembly having both a top and a fixed side with first slots, second slots, and storage slots disposed between the first and second slots. The frame assembly further includes an open frame bottom that is attached at one (1) end to the fixed side. The bottom has two (2) vertical side plates and a plurality of interconnecting rods. The frame assembly further includes a downward protruding first insert. The portable display further includes a removable side that is configured to be received by the top and bottom. The removable side includes a downward protruding second insert. A first horizontal support structure has a first receiver for receiving the first insert, a second horizontal support structure having a second receiver receives the second insert. A first pair of adjustable legs are attached to the first horizontal support structure while a second pair of adjustable legs are attached to the second horizontal support structure. The first slots are configured to retain a first sign panel visible from a first direction, the second slots are configured to retain a second sign panel visible from a second direction; and the storage slots are configured beneficially includes a sign panel inserted into the first slots and a second sign panel inserted into the second slots. The removable side preferably includes a first exterior slot aligned with the first slots and a second exterior slot aligned with the second slots.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
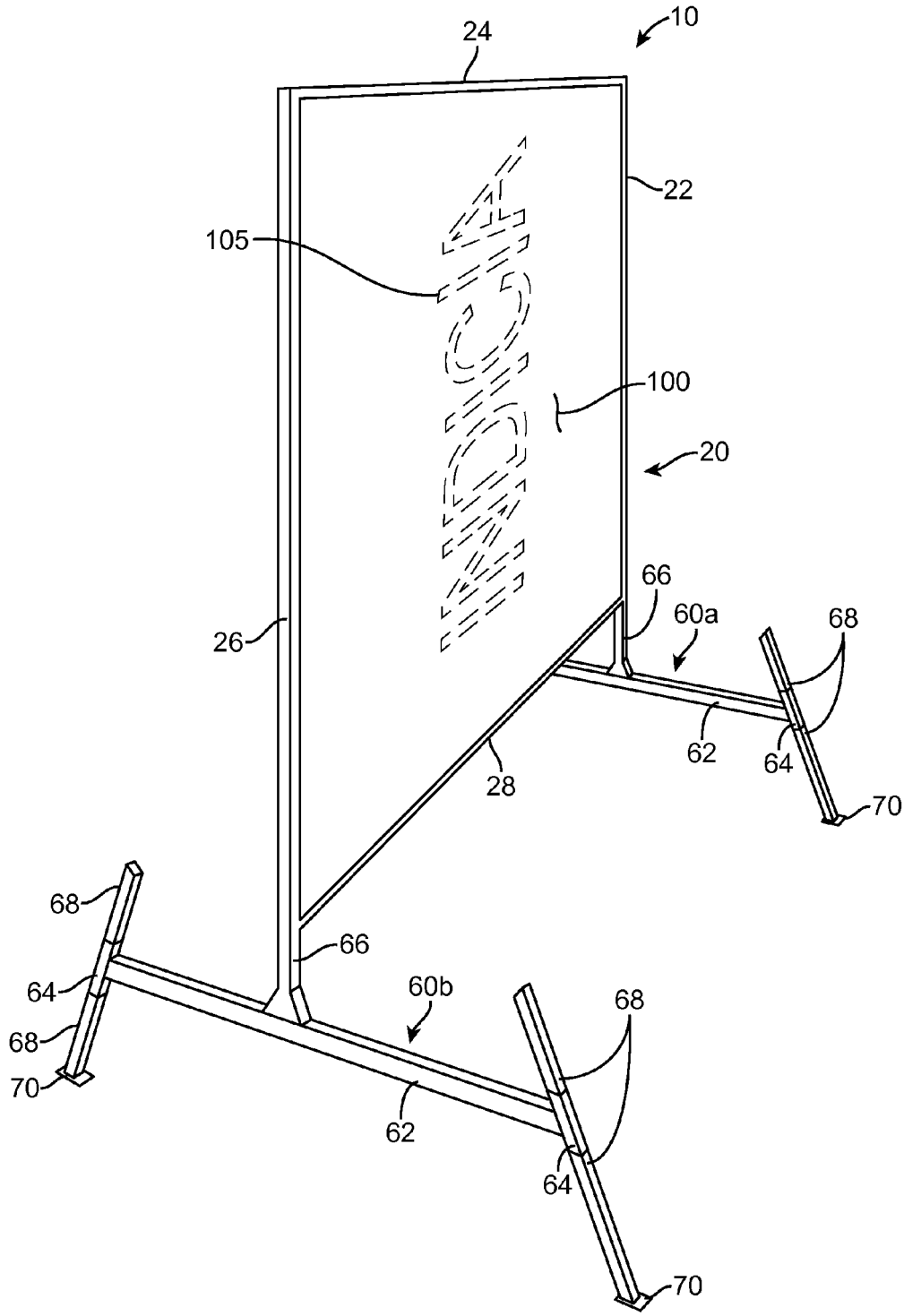
FIG. 1 is a side perspective view of a portable display 10 according to a preferred embodiment of the present invention.

10 portable signage display apparatus
20 frame assembly
22 first side member
24 top member
26 second side member
28 bottom member
30 first side plate
32 second side plate
34 support rod
36 first mating plate
38 fastener aperture
40 insert
42*a* sign slot
42*b* storage slot
44 threaded aperture
46 second mating plate
52*a* horizontal signage slot
52*b* horizontal storage slot
60*a* first support structure assembly
60*b* second support structure assembly
62 cross-member
64 connector
66 receiver
68 adjustable leg
70 footplate
72 anchoring aperture
80 welded nut fastener
82 fastener
100 signage panel
105 indicia

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

FIG. 1 shows a side perspective view of a portable display 10 that is in accord with a preferred embodiment of the present invention. The portable display 10 provides a portable, free-standing rectangular frame assembly 20 which houses and vertically displays a plurality of user-provided sign panels 100. The frame assembly 20 includes a single removable side 26 that enables easy insertion or repositioning of displayed sign panels 100 to provide bi-directional displays of viewing of indicia 105. Typically such indicia 105 will be printed on the sign panels 100.

It is understood that variously sized models of portable display 10 and frame assemblies 20 will be made available in a variety of heights and widths that are suitable for displaying different sized sign panels 100. Such sign panels 100 will be made available in accord with a user's preference. It is envisioned that the sign panels 100 will be made using a rugged weather-resistant material similar to commercially-available products such as ALCOBOND®, DIBOND®, and the like. The sign panels 100 are further envisioned as being double sided and having indicia 105 on both sides. Typical indicia 105 may be advertisements, sports names/logos, personal names, various images and symbols, pictures, and the like. The very nature of the double sided sign panels 100 enables easy flipping to present other indicia 105.

Still referring to FIG. 1, the frame assembly 20 also includes a pair of horizontal support structures 60*a*, 60*b* to provide stable positioning of the portable display 10 on the ground or other surface. The frame assembly 20 also includes specific features that prevent moisture, snow, or ice, which could damage the portable display 10, from accumulating within the frame assembly 20.

Figure 2:
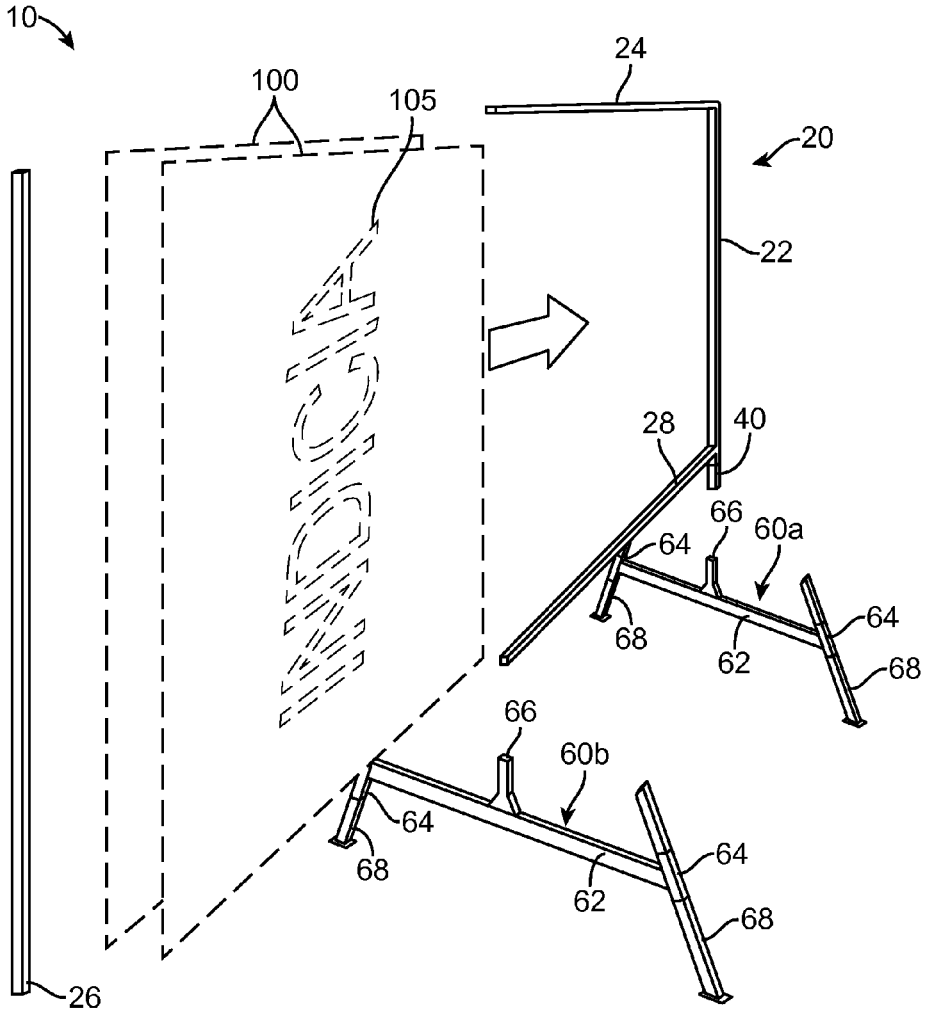
FIG. 2 is an exploded view of the portable display 10 shown in FIG. 1.
Figure 5:
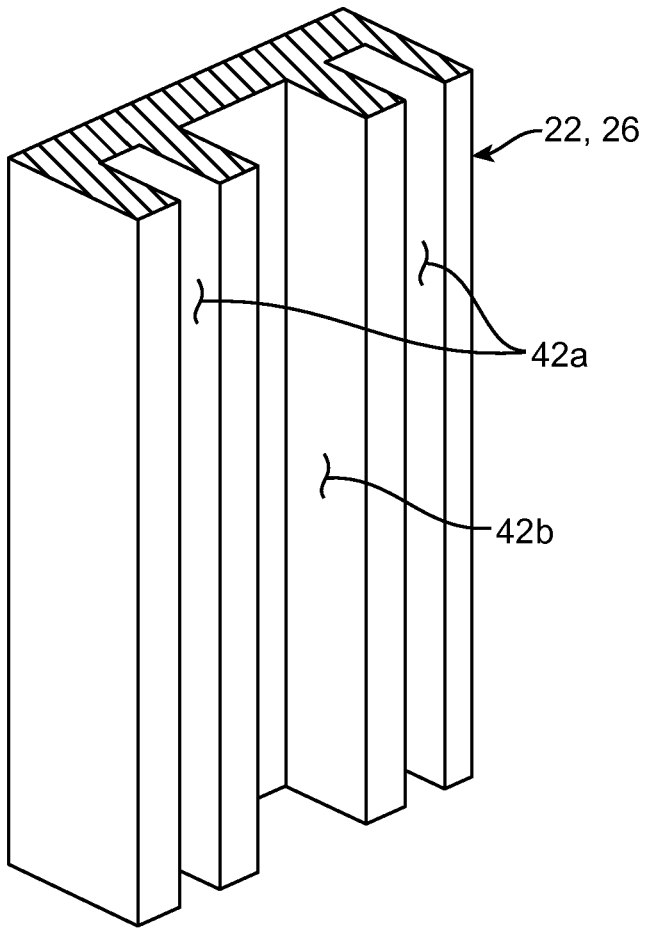
FIG. 5 presents a cutaway view of a section of the side members 22, 26 of the frame assembly 20 shown in FIGS. 3*a* and 3*b*; and, FIG. 6 is a side perspective view of an adjustable leg portion 68 of the support structure assembly 60*a* and 60*b*.

Referring now to FIG. 2, the frame assembly 20 provides a rectangular structure having a first side member 22, a top member 24, the removable second side member 26, and a bottom member 28. Referring now also to FIG. 5, the top member 24 and the side members 22, 26 form a three-sided structure that is preferably made using slotted rectangular metal forms having sign slots 42*a* for retaining sign panels 100 and storage slots 42*b* for storing and hiding extra or different sign panels 100. The sign slots 42*a* have inner surfaces that capture the edges of the sign panels 100.

Referring back to FIG. 3*a*, the bottom member 28 has an open construction comprised of vertical side plates 30, 32 and a plurality of interconnecting rods 34 onto which the sign panels 100 rest. This configuration provides drainage and ventilation for water, snow, and the like (also see FIG. 3*b*).

Referring once again to FIG. 2, the first side member 22, top member 24, and bottom member 28 form a unitary three-sided structure that is preferably formed by welding at right angles. As previously noted the top and bottom ends of the second side member 26 are removable from the top member 24 and the bottom member 28. This allows a user to easily remove the second side member 26 to enable insertion, rearrangement, and removal of the sign panels 100.

Figure 3A:
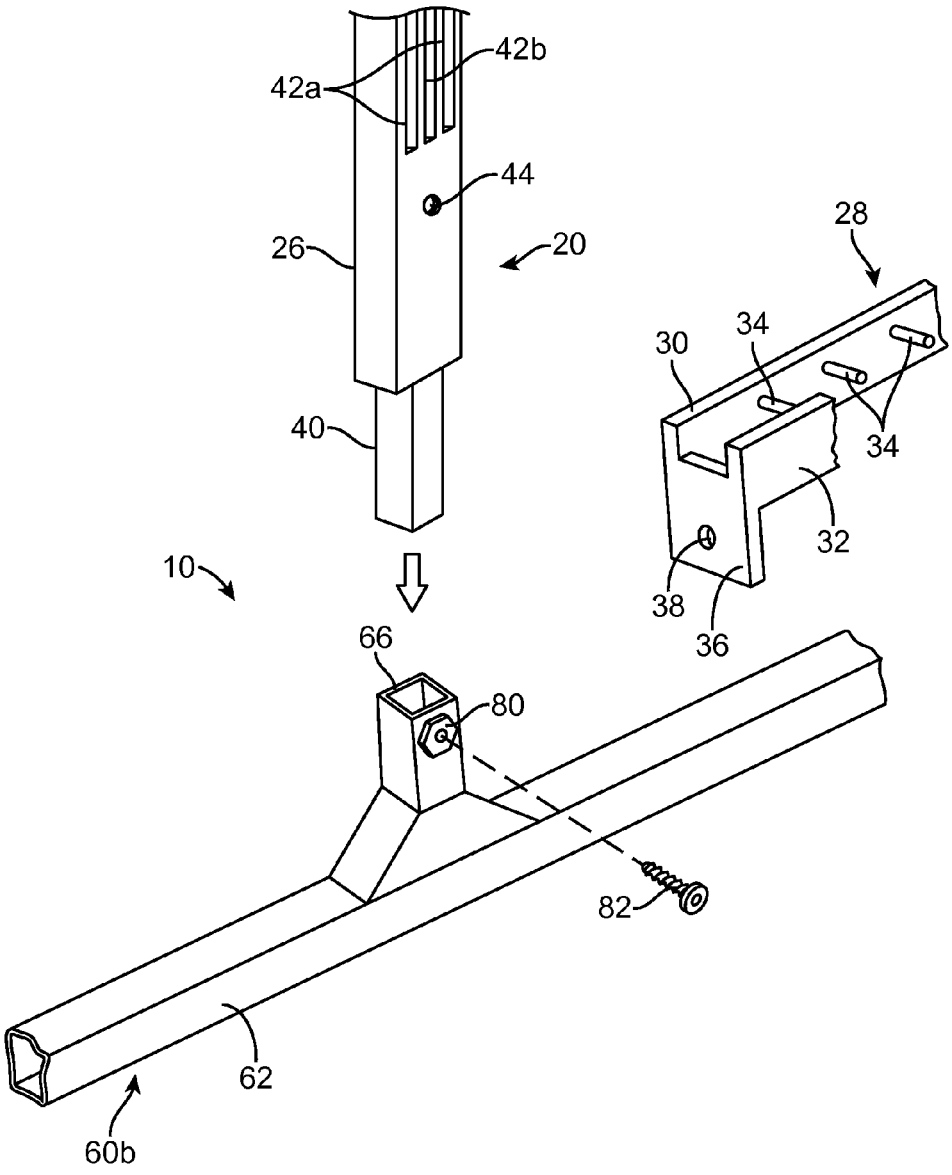
FIG. 3*a* is close-up view of a frame assembly 20 and support structure assembly 60*b* used in the portable display 10 shown in FIGS. 1 and 2.

Referring now to FIGS. 2 and 3*a*, the bottom ends of the vertical side members 22, 26 each include an insert 40 which fits into a respective receiver 66 of the first support structure assembly 60*a* and the second support structure assembly 60*b*. Each support structure assembly 60*a*, 60*b* also includes a pair of vertically adjustable legs 68 which enable stable positioning of the portable display 10 on the ground surface or other surface.

Figure 3B:
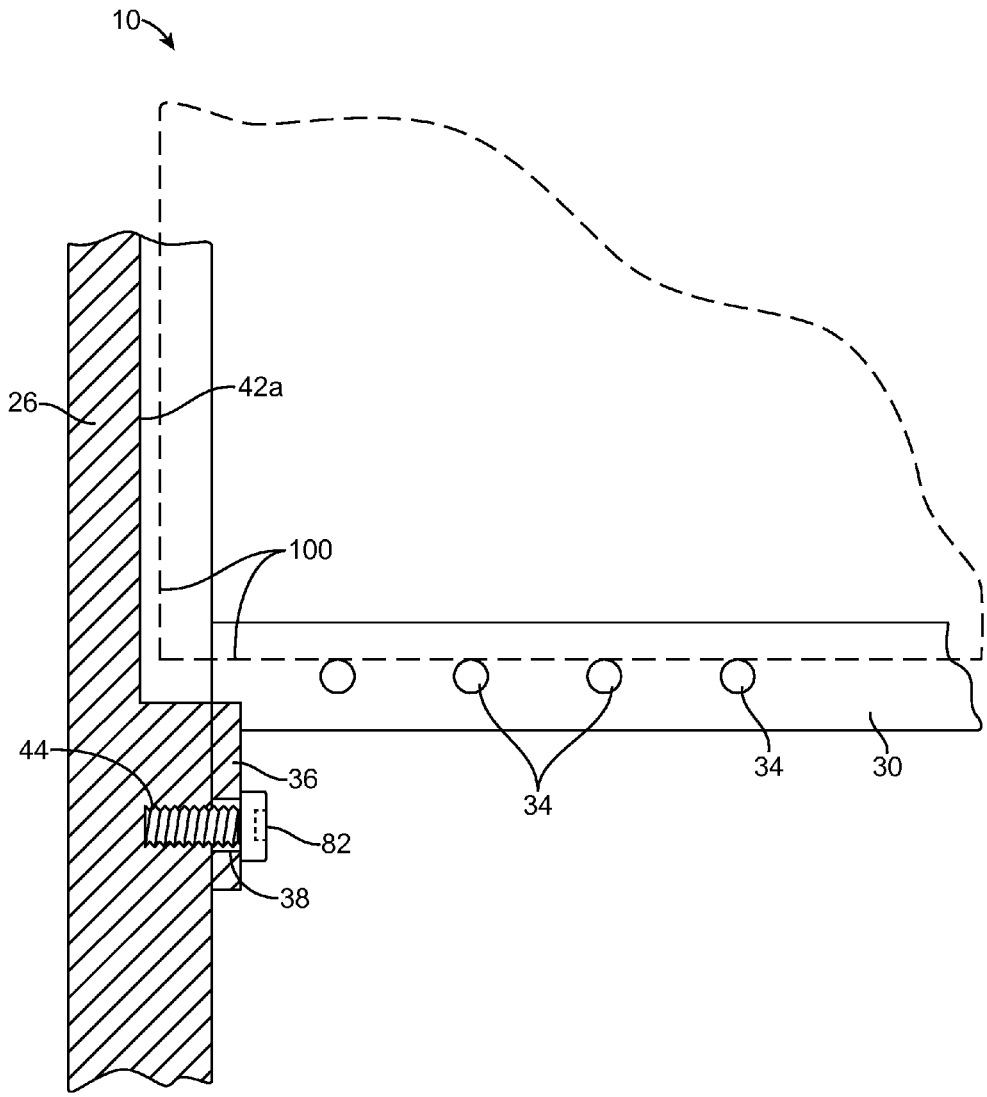
FIG. 3*b* is side cut-away view of part of the frame assembly 20 and a first side plate 30 of the portable display 10 shown in FIGS. 1 and 2.

Referring now to FIGS. 3*a* and 3*b*, the second side member 26 provides a fastening attachment to the bottom member 28 that runs at a right angle by abutting a first mounting plate 36 against the second side member 26. The first mounting plate 36 comprises a downward facing surface that extends from the bottom member 28. The first mounting plate 36 is securely fastened to inside the second side member 26 via fasteners 82 that pass through aligned fastener apertures 38 and into threaded apertures 44. The fasteners 82 are envisioned as being threaded members having integral heads that beneficially require a specialized tool for installation or removal. Such fasteners are available as star key fasteners, socket head cap screws, and the like. The special features of the fasteners 82 are intended to reduce tampering and unauthorized disassembly of the portable display 10.

As noted, the second side member 26 inserts into the second support structure assembly 60*b* using an insert 40 that enters into a receiver 66. The preferred embodiment of the insert 40 and receiver 66 are rectangular tubing elements. Such enables easy assembly and prevents twisting. The receiver 66 beneficially includes a welded nut fastener 80 and a fastener 82. The second side member 26 is securely retained within the receiver 66 by attaching the fastener 82 to obtain a pinching grip against the internal insert 40. In a similar manner, the first side member 22 is fixed to the first support structure assembly 60*a* using an insert 40 and a receiver 66 (reference FIGS. 1 and 2).

Positioning a sign panel 100 is illustrated in FIGS. 3*a*, 3*b* and 5. A sign panel 100 is inserted into a sign slot portion 42*a* of the second side member 26 and supported by the support rods 34 of the bottom member 32.

Figure 4A:
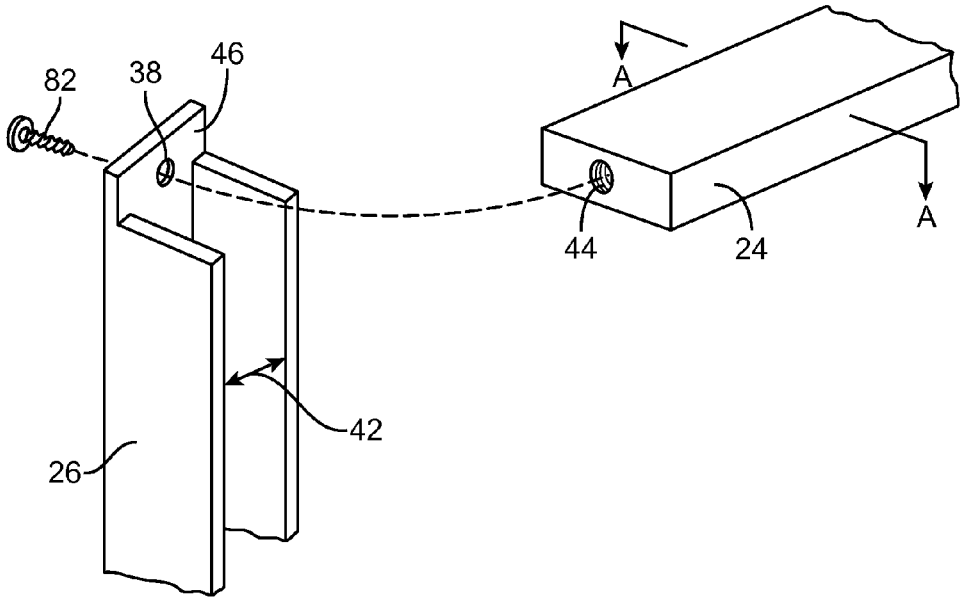
FIG. 4*a* is a perspective view of a second side member 26 and a top member 24 of the frame assembly 20 shown in FIGS. 3*a* and 3*b;*
Figure 4B:
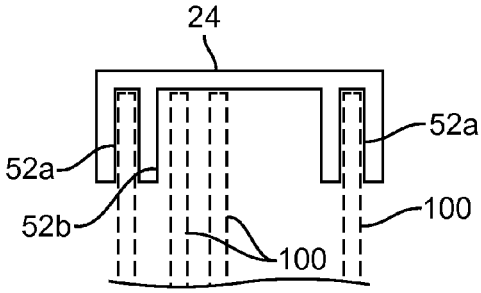
FIG. 4*b* is a section view of the top member 24 taken along section line A-A of FIG. 4*a;*

FIGS. 4*a* and 4*b* respectively provide perspective and section views of the second side 26 and top 24 members. The second side member 26 attaches to the top member 24 via a second mating plate 46. Attachment is performed by abutting the top member 24 against the second mating plate 46 and then tightening using a fastener 82 that passes through aligned threaded apertures 44 and fastener apertures 38.

The top member 24 includes a pair of horizontal sign slots 52*a* and a horizontal storage slot 52*b* that are beneficially machined or formed along the top member 24. The horizontal sign slots 52*a* are configured to align with the previously described sign slots 42*a* of the first 22 and second 26 side members. Collectively the sign slots 52*a*, 42*a* can receive two (2) sign panels 100 to provide bi-directional indicia 105. Furthermore, the top storage slot 52*b* aligns with the side storage slots 42*b* to provide a convenient storage location for other sign panels 100.

FIG. 5 illustrates a cutaway section of the side members 22, 26 and shows the sign slots 42*a* and storage slot 42*b* in more detail. The side members 22, 26 act in conjunction with the previously described top member 24 to securely position the sign panels 100 along the outer edges. The side members 22, 26 also show the storage slot 42*b* that aligns with the top storage slot 52*b* (reference FIG. 4*b*) to provide storage for a plurality of sign panels 100 for subsequent use.

Figure 6:
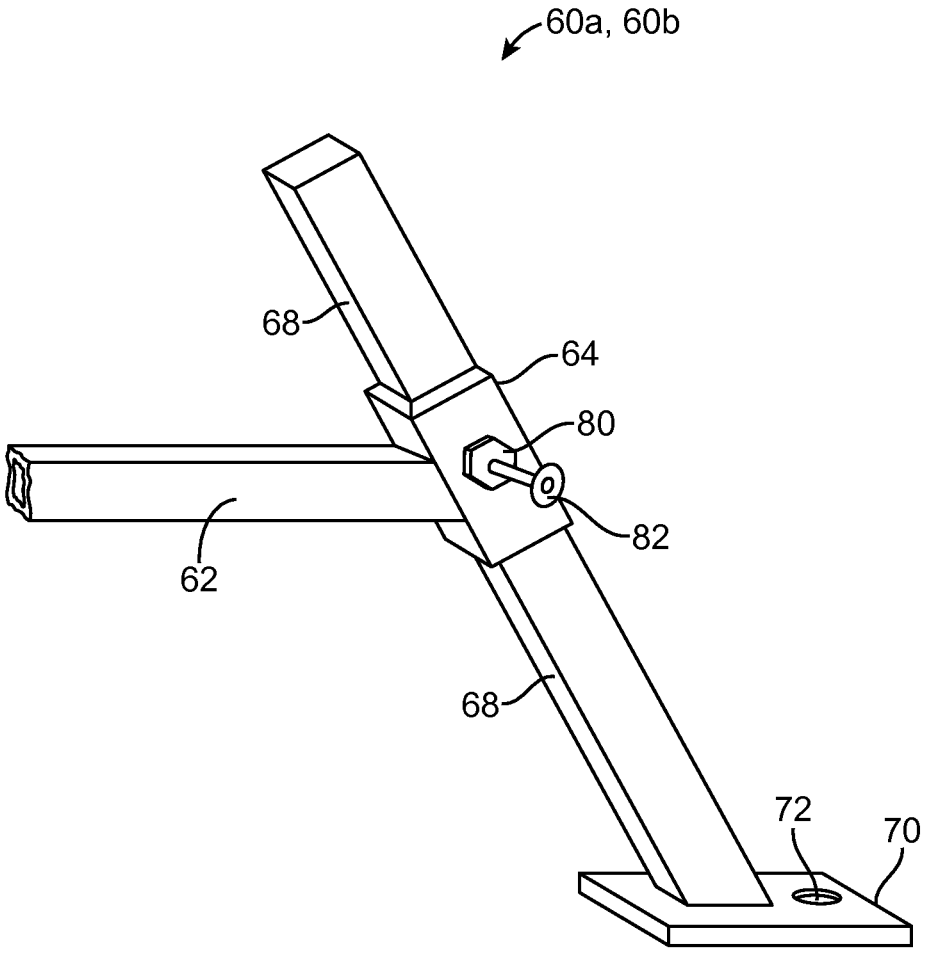

FIG. 6 presents a side perspective view of an adjustable leg 68 of the support structure assemblies 60*a*, 60*b*. The first support structure assembly 60*a* provides an attachment and support for the first side member 22. The second support structure assembly 60*b* provides attachment and support for the second side member 26. Each support structure assembly 60*a*, 60*b* comprises a unitary weldment having a cross-member 62, a pair of connectors 64, and the receiver 66. The integral receiver 66 (See FIG. 1) is located on top of, and along a cross-member 62.

Each connector 64 is located at an end of the cross-member 62. Each connector 64 preferably comprises a length of rectangular tubing approximately six (6) inches in length and angled downward and outward from the cross-member 62 at approximately a forty-five degree (45°) angle. Each connector 64 has internal dimensions that closely receive an adjustable leg 68. There are four (4) adjustable legs 68. Additionally, each connector 64 comprises a welded nut fastener 80 having a threaded fastener 82 on a side surface. In use, an adjustable leg 68 is inserted through each connector 64 and a respective fastener 82 is then threaded into nut fastener 80 and tightened to obtain a pinching grip. Each adjustable leg 68 preferably comprises a length of rectangular tubing having a footplate 70 welded to a bottom end portion. Each leg 68 is adjustable to position the frame assembly 20 as desired.

The adjustable legs 68 each include a welded footplate 70. Each footplate 70 is preferably a rectangular section of flat stock that is angled with respect to its leg 68 to be parallel with the ground. Each footplate 70 includes a drilled or formed anchoring aperture 72 that enables a user to stake out or otherwise anchor the portable display 10 to the ground.

The preferred embodiment of the present invention can be utilized by the common user in a simple and effortless manner with little or no training. After initial purchase or acquisition of the portable display 10, it would be installed as indicated in FIGS. 1 and 2.

The method of installing and using the portable display 10 is achieved by: procuring a portable display 10 having a desired height and width dimensions; obtaining sign panels 100 dimensioned to fit the frame assembly 20, preferably those sign panels 100 will have indicia 105 on both sides; removing the second side member 26 from the top 24 and bottom 28 members by removing the fasteners 82 using a specialized tool; inserting a sign panel 100 into the horizontal slot 52*a* of the top member 24 until seated within the corresponding slot 42*a* of the first side member 22; installing a second signage panel 100 in like manner within the remaining horizontal signage slot 52*a* and vertical signage slot 42*a*; inserting additional signage panels 100 into the horizontal storage slot portion 52*b* of the top member 24 and vertical storage slot portion 42*b* of the first side member 22, as desired; affixing the second side member 26 to the top 24 and bottom 28 members using respective second mating plate 46 and first mating plate 36 portions; replacing and tightening the previously removed fasteners 82; attaching the first 60*a* and second 60*b* support structure assemblies to respective first 22 and second 26 side members by inserting insert portions 40 into receiver portions 66, respectively; securing the support structure assemblies 60*a*, 60*b* to the first 22 and second 26 side members by tightening the fasteners 82 to establish a pinching grip; placing the portable display 10 on the ground; adjusting the adjustable leg portions 68 by motioning the adjustable legs 68 within corresponding connectors 64 until obtaining a desired position of the frame assembly 20; securing the adjustable legs 68 in position by tightening the fastener portions 82 of each connector 64 until obtaining a secure pinching grip; anchoring the footplate 70 of each adjustable leg 68 to the ground, if desired, using the anchoring apertures 72 to stake or otherwise anchor the portable display 10 to the ground; and, benefiting from a portable and attractive display of signage panels 100 afforded a user of the present invention 10.

The method of reconfiguring the portable display 10 to display additional sign panels 100 envisioned to have different indicia 105 may be achieved by removing the second side member 26 as previously described; removing, flipping, and reinserting the previously displayed sign panels 100 within the sign slots 42*a*, 52*a* to display the previously hidden side surface of the sign panels 100, or; replacing the previously displayed sign panels 100 with other sign panels 100 stored within the sign slots 42*b*, 52*b*; and, replacing the second side member 26.

Another method of using the portable display 10 is procuring and inserting a single sign panel 100 within the centrally-positioned storage slot 42*b*; assembling the frame assembly 20 and support structures 60*a*, 60*b* as previously described; and, displaying the desired indicia 105.

The portable display 10 may be completely disassembled by loosening and/or removing the fasteners 82 using a specialized tool designed to install or remove the fasteners 82, thus allowing the portable display 10 to be transported in a common motor vehicle, truck, or trailer, as desired.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A portable display, comprising:

a frame assembly including a three-sided structure with a top, a fixed side, and a bottom, wherein said top and said fixed side include first slots, second slots, and storage slots disposed between said first slots and said second slots, said frame assembly further including a downward protruding insert;

a removable side configured to be received by said top and bottom;

a horizontal support structure having a receiver for receiving said insert; and, an adjustable leg attached to said horizontal support structure;

wherein said first slot is configured to retain a first sign panel visible from a first direction;

wherein said second slot is configured to retain a second sign panel visible from a second direction; and, wherein said storage slot is configured to retain at least one non-viewable sign panel.

2. The portable display according to claim 1, further including at least two sign panels having indicia.

3. The portable display according to claim 2, wherein said at least two sign panels are comprised of a rugged weather-resistant material.

4. The portable display according to claim 2, wherein said at least two sign panels have indicia on both sides.

5. The portable display according to claim 1, wherein said bottom is an open structure having two vertical side plates and a plurality of interconnecting rods.

6. The portable display according to claim 1, further including a mating plate for attaching said removable side to said top.

7. The portable display according to claim 6, further including threaded apertures retaining said removable side to said mating plate.

8. A portable display, comprising:

a frame assembly having both a top and a fixed side with first slots, second slots, and storage slots that are disposed between said first slots and said second slots, said frame assembly further including an open frame bottom attached at one end to said fixed side, said bottom having two vertical side plates and a plurality of interconnecting rods; said frame assembly further including a first downward protruding insert;

a removable side configured to be received by said top and bottom;

a first horizontal support structure having a first receiver for receiving said first insert; and, an adjustable first leg attached to said first horizontal support structure for supporting the portable display;

wherein said first slots are configured to retain a first sign panel visible from a first direction;

wherein said second slots are configured to retain a second sign panel visible from a second direction; and, wherein said storage slots are configured to retain at least one non-viewable sign panel.

9. The portable display according to claim 8, further including a first sign panel inserted into said first slots and a second sign panel inserted into said second slots.

10. The portable display according to claim 9, further including a third sign panel inserted into said storage slots.

11. The portable display according to claim 9, wherein at least said first sign panel has indicia on both sides.

12. The portable display according to claim 8, further including a mating plate for attaching said removable side to said top.

13. The portable display according to claim 12, further including threaded apertures retaining said removable side to said mating plate.

14. The portable display according to claim 13, wherein said removable side including a first exterior slot aligned with said first slots and a second exterior slot aligned with said second slots.

15. The portable display according to claim 13, wherein said removable side includes a downward protruding second insert and a mounting plate for attaching to said bottom.

16. The portable display according to claim 13, further including a second horizontal support structure having a second receiver for receiving said second insert.

17. The portable display according to claim 16, further including a second leg attached to said second horizontal support structure, wherein said second leg includes footplate having an aperture.

18. A portable display, comprising:

a frame assembly having a top and a fixed side configured with first slots, second slots, and storage slots disposed between said first slots and said second slots, said frame assembly further including an open frame bottom attached at one end to said fixed side, said bottom having two vertical side plates and a plurality of interconnecting rods, said frame assembly further including a downward protruding first insert;

a removable side configured to be received by said top and bottom and including a downward protruding second insert;

a first horizontal support structure having a first receiver for receiving said first insert;

a second horizontal support structure having a second receiver for receiving said second insert;

a first pair of adjustable legs attached to said first horizontal support structure; and, a second pair of adjustable legs attached to said second horizontal support structure;

wherein said first slots are configured to retain a first sign panel visible from a first direction;

wherein said second slots are configured to retain a second sign panel visible from a second direction; and, wherein said storage slots are configured to retain at least one non-viewable sign panel.

19. The portable display according to claim 18, further including a sign panel inserted into said first slots and a second sign panel inserted into said second slots.

20. The portable display according to claim 18, wherein said removable side includes a first exterior slot aligned with said first slots and a second exterior slot aligned with said second slots.

* * * * *